US005590542A

United States Patent [19]

Wang

[11] Patent Number: 5,590,542

[45] Date of Patent: Jan. 7, 1997

[54] DUAL CANTEEN AND INTERIOR COOLER

[76] Inventor: Paul S. Wang, 22428 Steeplechase La., Diamond Bar, Calif. 91765

[21] Appl. No.: 562,416

[22] Filed: Nov. 24, 1995

[51] Int. Cl.[6] ..... F25D 3/08

[52] U.S. Cl. ..... 62/457.3; 220/705

[58] Field of Search ..... 62/371, 457.2, 62/457.3, 457.4, 457.1; 220/705, 707, 708, 709

[56] References Cited

U.S. PATENT DOCUMENTS

| | | | |
|---|---|---|---|
| 2,468,661 | 4/1949 | Gladstone | 62/457.2 |
| 3,840,153 | 10/1974 | Devlin | 220/709 |
| 4,441,640 | 4/1984 | Lottick | 62/457.2 |
| 4,925,040 | 5/1990 | Wang | 220/705 |
| 5,129,238 | 7/1992 | Schwartz et al. | 62/457.3 |
| 5,282,541 | 2/1994 | Chen | 220/705 |
| 5,472,274 | 12/1995 | Baillie | 366/129 |

*Primary Examiner*—William Doerrler

[57] ABSTRACT

A canteen for use on picnics and other outings and which is capable of holding a first drink, such as water, lemonade, frozen daiquiris, etc., and which includes a cover through which the first drink may be consumed through a tubular straw member. A capsule is provided for holding a second drink; the capsule being removably held in a bracket formed on the underside of the cover, with the capsule extending down into the drink in the canteen. The capsule is previously placed in a freezer in order to freeze the second drink, so that the second drink may serve to cool the first drink during the outing. The capsule may subsequently be removed and the cool, melted second drink may be drunk through a neck formed in the upper end of the capsule.

2 Claims, 2 Drawing Sheets

FIG. 3
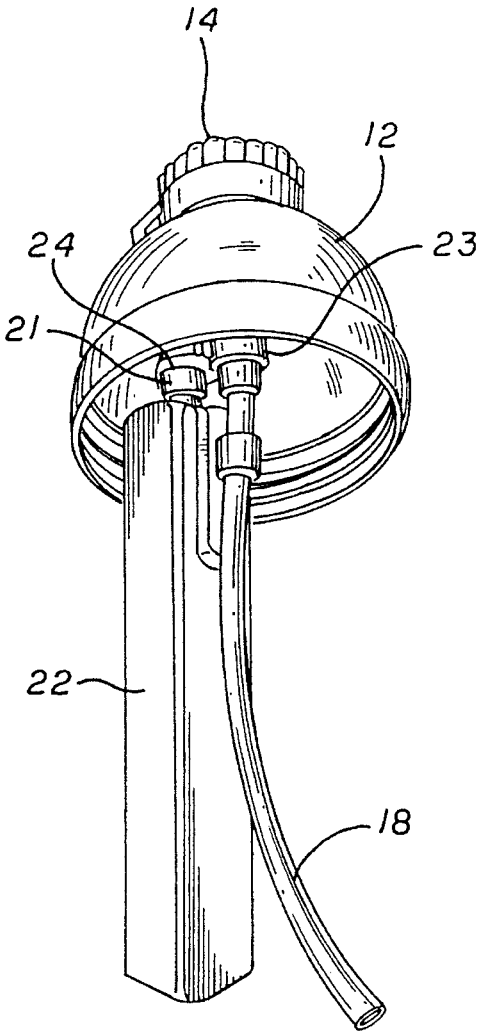
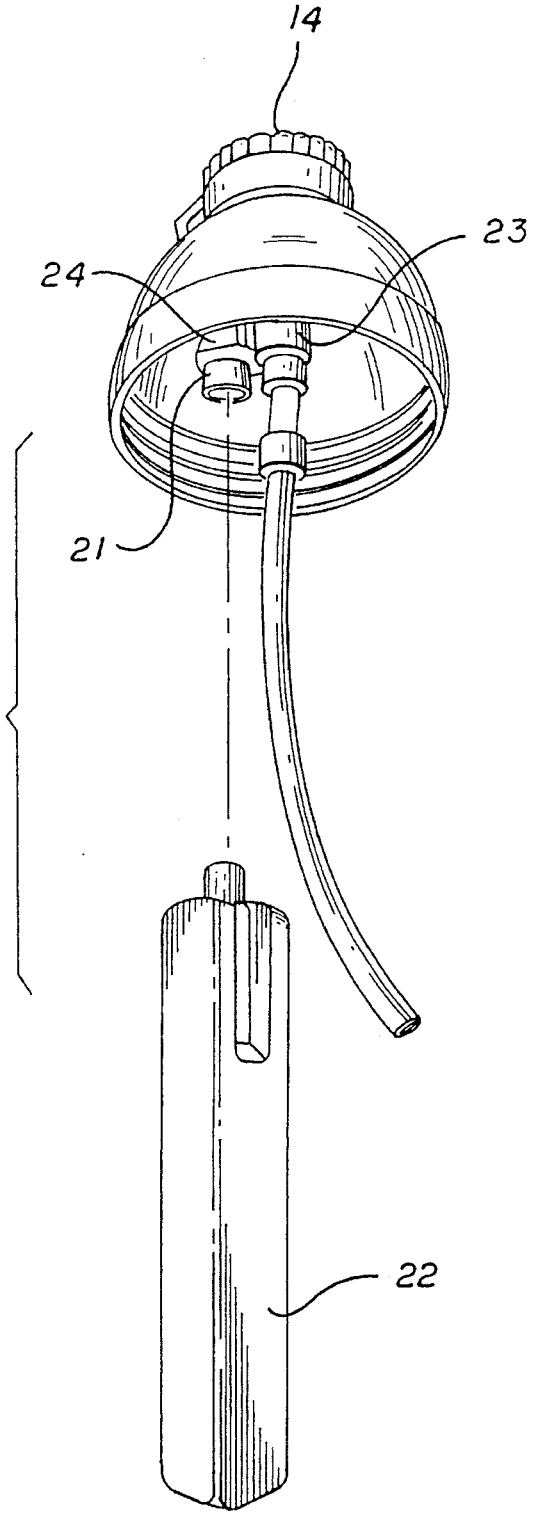
FIG. 4

DUAL CANTEEN AND INTERIOR COOLER

BACKGROUND OF THE INVENTION

The invention is directed to a dual action canteen that may conveniently be carried on camping trips, picnics, games and the like, which is capable of holding two different liquid drinks, such as water, lemonade, and other drinks, one of which may be initially frozen in a freezer to act as a coolant for the other as the frozen drink melts during the outing. The frozen drink is contained in a tubular cartridge which is removably attached to the underside of the cover of the container and extends down into a liquid drink contained in the container. After the frozen drink has melted, the tubular cartridge may be removed and the previously frozen drink may be drink consumed through an open neck formed in the capsule.

The dual action canteen of the invention serves not only as a container for two types of liquid drinks, but it also acts as a cooler for one of the drinks, with the other drink being initially frozen to cool the first drink as it melts in the canteen, and to be consumed after it has melted.

The canteen of the invention acts as a cooler but obviates any need for dangerous chemical refrigerants, and it is safe for children to use. The canteen also serves to keep the drink in the container cool without any dilution of the drink and without the need for messy ice cubes.

The canteen of the invention in the specific embodiment illustrated herein and to be described is similar in some respects to the canteen disclosed in my U.S. Pat. No. 4,925,140 which issued May 15, 1990. The canteen described in the patent is cylindrical in shape with an open top and a cover threaded to the open top. A latched cap is pivotally mounted on the cover, which when closed engages the upper end of a spring-loaded tubular member that extends down into the interior of the canteen. Accordingly, the pivotally mounted cap normally holds the tubular member down in a retracted position. However, when the latch is released, the cap pivots upwardly, and the tubular member pops up through the cover so that the liquid which is contained in the canteen may be sucked through the tubular member.

A tubular cartridge is removably mounted in a bushing formed on the underside of the cover of the canteen of the present invention, and the cartridge is frictionally held in the bushing in a position to extend down into the first drink in the container. The cartridge may previously be filled with a second drink and placed in a freezer to freeze the second drink prior to being mounted in the canteen. Then, when the canteen is to be used, the cartridge is removed from the freezer and mounted in place under the cover of the canteen. The canteen is filled with the first drink, and the cover is then screwed into place with the capsule extending down into the first drink.

During the outing, the second drink inside the capsule melts and may subsequently be drunk through a neck formed in the open top of the capsule after the cover has been unscrewed from the canteen and the capsule removed from the bushing. The liquid drink within the canteen is cooled by the frozen drink in the capsule and may be drunk at any time by opening the latched cap and sucking the cooled drink through the tubular member in its popped up condition.

BRIEF DESCRIPTION OF THE DRAWINGS

FIG. 3 is a perspective representation of the cover of the canteen of FIGS. 1 and 2, taken from the lower side of the cover and showing a cartridge and other elements that are mounted on the underside of the cover; and FIG. 4 is a view like FIG. 3, but with the cartridge detached from the cover.

DETAILED DESCRIPTION OF THE ILLUSTRATED EMBODIMENT

Figure 1:
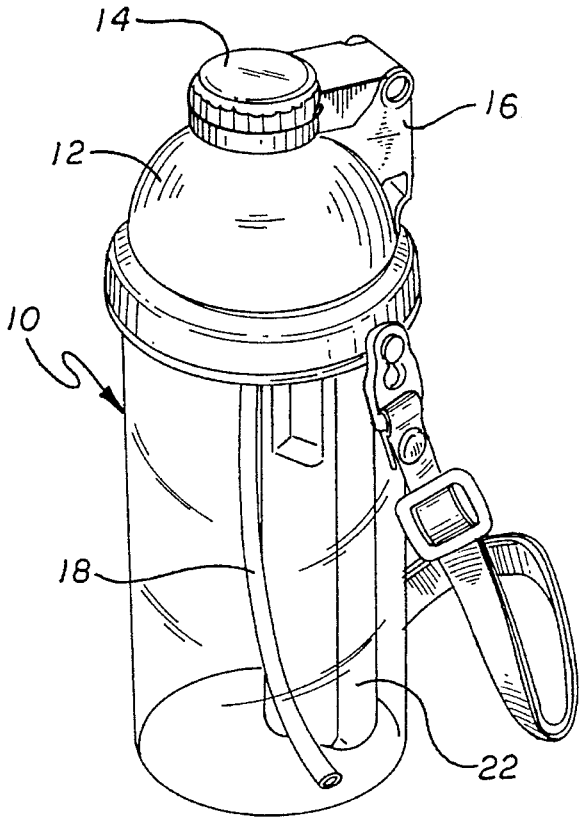
FIG. 1 is a perspective representation of a dual type canteen constructed in accordance with the present invention in one of its embodiments and which includes a cap pivotally mounted on its cover and latched in a closed position.

The canteen, as shown in the drawings, includes a tubular container 10 which may be formed, for example, of a transparent plastic material such as polyethylene. The container 10 has a closed bottom, and an open top. A cover 12 is threaded to the open top of the tubular container 10.

Figure 2:
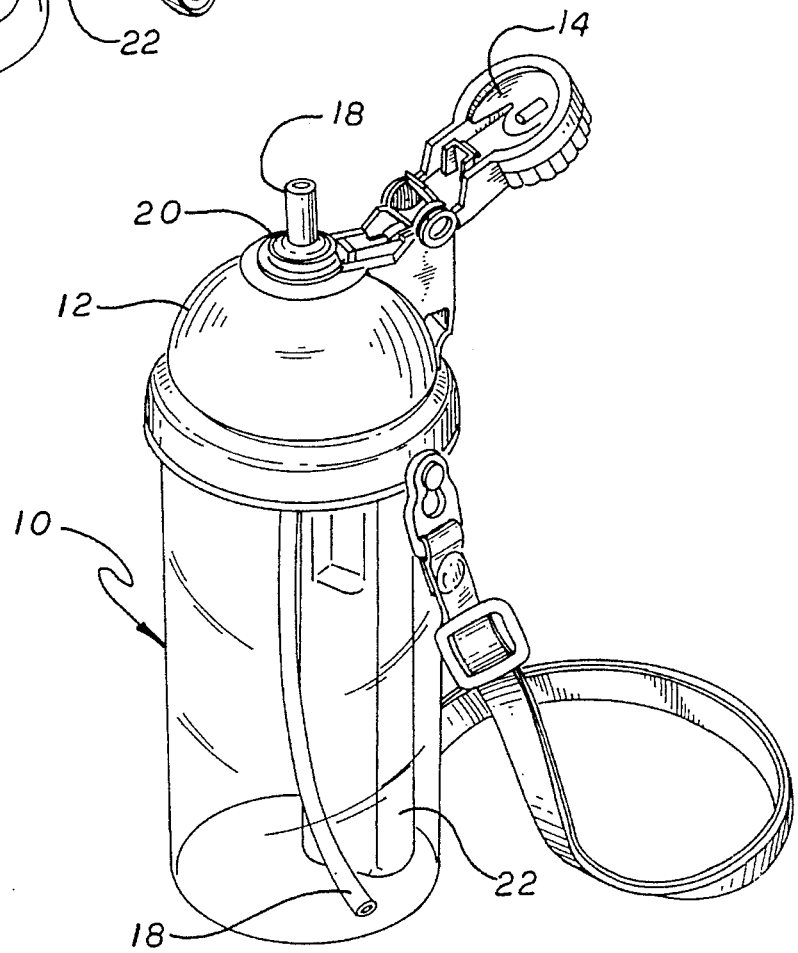
FIG. 2 is a perspective view, like FIG. 1, but with the latched cap mounted on the cover of the canteen in an open position.

A latched cap 14 is pivotally mounted on the cover 12 by means of an appropriate mechanism 16, as described in detail in the patent referred to above. The cap 14 may be turned down to a latched position shown in FIG. 1, and may be caused to swing up to the open position of FIG. 2 when the latch is operated, this action being described in detail in the patent referred to above.

A tubular member 18 is mounted in an appropriate sleeve 20 in the cover 12, and which extends through the cover. Tubular member 18 serves as a drinking straw. A spring-biasing mechanism is contained in the sleeve 20, and as described in the patent, and when cap 14 is unlatched, the spring-biasing mechanism causes tubular member 18 to pop up through cover 12 from the position shown in FIGS. 1 and 3 to the position shown in FIG. 2. When the tubular member 18 is in its extended position of FIG. 2, the user may suck the liquid out of the canteen by placing his or her lips around the projecting part of the tubular member.

In accordance with the present invention, a tubular capsule 22 is supported within the canteen in a bracket 24 formed on the underside of the cover 12, as best shown in FIGS. 3 and 4. The capsule 22 has a closed bottom and an open bushing which extends into a neck 21 formed in the bracket 24 in frictional relationship, and causes the capsule to be removably held in the bracket.

In using the canteen of the invention, the cover 12 is first removed from the canteen, and the capsule 22 is pulled away from the bracket 24. A liquid drink is then poured into the capsule 22 through its open neck, and an appropriate stopper is provided. The capsule is then placed in a freezer so that the liquid drink in the capsule may be frozen.

When the canteen is actually to be used, a second drink is poured into the canteen 10 through its open top. The neck of capsule 22, containing the frozen drink, is then plugged into the bushing 21 of bracket 24 so that the capsule may be frictionally held in the bracket and the cover 12 is screwed onto the top of the canteen. The capsule 22 extends down into the liquid in the canteen and the frozen drink within the capsule serves as a coolant for the liquid in the canteen. The canteen is then carried to the location where it is to be used. During the outing the frozen drink inside capsule 22 melts at least partially and cools the drink contained in the canteen. At any time, the drink contained in the canteen may be drunk by unlatching the cap 14, and sucking the drink out through the tubular member 18. When it is desired to drink the liquid inside capsule 22, the cover 12 is removed and the capsule is removed from bracket 24.

The invention provides, therefore, a simple dual purpose canteen in which two different drinks may be placed, with one drink cooling the other.

It will be appreciated that while a particular embodiment of the invention has been shown and described, modifications may be made. It is intended in the claims to cover all modifications which come within the true spirit and scope of the invention.

I claim:

1. A canteen including: a container for a first liquid drink having a cover; a capsule for a second liquid drink removably mounted on the underside of said cover and extending downwardly into the first liquid drink in said container, said capsule being adapted to be placed in a freezer prior to being mounted on the underside of said cover to freeze said second liquid drink so that said second liquid drink may serve as a coolant for said first liquid drink, in which said capsule has a neck section formed in the top thereof to serve as a drinking spout for the second liquid drink in said capsule.

2. The canteen defined in claim 1, and which includes a bracket formed on the underside of said cover having a bushing for removably receiving said neck section of said capsule in a friction fit.

* * * * *